United States Patent [19]

Straborny

[11] 4,358,112

[45] Nov. 9, 1982

[54] FINGER HOLE INSERT FOR BOWLING BALLS

[76] Inventor: Andrew J. Straborny, 14 Third Pk., Milford, Conn. 06460

[21] Appl. No.: 299,272

[22] Filed: Sep. 4, 1981

[51] Int. Cl.[3] ..... A63B 37/00

[52] U.S. Cl. ..... 273/63 A; 273/DIG. 10; 273/DIG. 29

[58] Field of Search ..... 273/63 R, 63 A, 63 B, 273/63 C, 63 D, 63 E, 63 F, 63 G, 64, DIG. 10, DIG. 29

[56] References Cited

U.S. PATENT DOCUMENTS

| | | | |
|---|---|---|---|
| 447,011 | 2/1891 | Harman | 273/63 A |
| 2,485,471 | 10/1949 | Bates | 273/63 A |
| 2,518,335 | 8/1950 | Klinkosh | 273/63 A |
| 2,777,693 | 1/1957 | Mitchell | 273/63 A |
| 3,804,412 | 4/1974 | Chetirko | 273/63 A |

*Primary Examiner*—George J. Marlo
*Attorney, Agent, or Firm*—Thomas L. Tully

[57] ABSTRACT

Novel ball-gripping inserts adapted to be attached within receiving holes bored into the surface of a bowling ball in order to provide lined finger- and thumb-receiving holes which improve the ability of the bowler to grip and release the ball in the desired manner. The present elements are molded from silicone rubber so as to be generally cylindrical, relatively thin-walled hollow elements which are adapted to receive the fingers and thumb of the bowler therewithin. An essential feature is the presence of a seat or finger tip-engaging portion at the base of the finger-receiving opening to limit and uniformly guide the extent to which the fingers are inserted. Another essential feature involves the presence of a cut or recess in the interior wall of the insert, in a location adjacent the fingernail of the bowler, to facilitate the entry of air and release the vacuum caused by the rapid removal of the fingers from the elements during release of the ball. A preferred method for making the inserts involves the use of mating male and female molds to define a cavity in which the silicone rubber molding composition is shaped. The female mold may be coated with a diene rubber prior to filling the mold cavity with the silicone rubber composition so that the formed insert will include an outer film of diene rubber.

5 Claims, 5 Drawing Figures

FINGER HOLE INSERT FOR BOWLING BALLS

BACKGROUND OF THE INVENTION

Bowling balls are provided with a number of holes, generally two finger holes and a thumb hole, which are drilled into the balls in order to permit the balls to be gripped in one hand and released with some degree of control during the act of bowling.

The position, location and sizes of the holes or bores will vary depending upon the size of the bowler's hand and fingers. Most bowlers purchase their own ball and have it custom-drilled to the size of their own hand and fingers. The holes must be sufficiently large to receive the fingers snugly but not so tightly that smooth release is interferred with.

One disadvantage of drilled holes or bores is that they are perfectly round, whereas it has been found preferable by most bowlers, particularly professional bowlers, that the release surface which is engaged by the fingerprint surface of the fingers should be flat in order to provide maximum "feel" and control during release of the ball.

Another disadvantage of drilled holes or bores is that such holes or bores have a hard inner surface which is uncomfortable to the touch, particularly in the case of professional bowlers who frequently bowl one hundred or more games each week for practice. Such lack of comfort interferes with control.

In order to overcome these problems, one or more diene rubber inserts have been developed and marketed for attachment within enlarged holes or bores on bowling balls. Such inserts are hose-type rubber elements which have a cylindrical outer surface, a uniform, relatively-thick wall and an inner surface having a flat portion in the area to be engaged by the finger-print surface of the fingers. These inserts are more comfortable than unlined holes and provide better ball control due to the flat surface. However, they are unsatisfactory for several reasons.

Firstly, such inserts are so long and large in diameter, due to the thick walls, that they require large diameter holes or bores to be drilled in the ball. This results in the removal of such an excess amount of weight from the ball that the uniform balance of the ball is disturbed or destroyed.

Secondly, such inserts have a finger-receiving opening or hole which is of uniform diameter from top to bottom. The finger of the bowler is inserted within said opening or hole to any desired depth. If the opening or hole tightly engages that finger, as can happen when the fingers swell during the progress of several games, the inside rubber surface of the insert can make airtight engagement with a substantial portion of the length of the finger, causing excessive resistance to removal of the finger during bowling due to the vacuum caused by the inability of external air to flow in and displace the area occupied by the finger, and also due to the length of the finger which is engaged by the rubber insert.

SUMMARY OF THE INVENTION

The present invention overcomes the problems presented by prior-known bowling ball inserts and further provides new and unobvious advantages which are not possessed by the prior-known inserts.

The present invention is based upon a number of important related discoveries. Firstly, silicone rubbers provide a better base material for bowling ball inserts than do the more conventional diene rubbers because they cure to form a smooth resilient surface which provides the desired feel and slip properties relative to the fingerprint surfaces of the fingers. Also, silicone rubbers are easily molded to form inserts which have thin but durable walls, thereby requiring a minimum weight of material to be removed from the ball to form an accommodating bore and maintaining the required balance in the ball.

Secondly, the novel inserts of the present invention are provided with a contoured seat or fingertip-engaging base which limits and renders uniform the extent to which the finger can be inserted, provides a resilient cushion for the fingertips and increases the area of the fingertip which makes contact with the ball, for improved feel and control, while preventing an excess length of the finger from being introduced and becoming secured, particularly if swelling occurs. In other words the present inserts limit the overall area of the finger which is received within the insert up to about the first joint but increase the area of the fingerprint and fingertip portions which make contact, said portions being the critical portions of the finger with respect to sensitivity or feel for the ball and controlled release of the ball for maximum accuracy.

According to a preferred embodiment, the present inserts are provided with an air slot or interior recess, located in the area of the insert adjacent the fingernail, in order to facilitate the escape of air when the finger is introduced to the insert, permitting complete and comfortable seating of the fingertip, and also to facilitate to admission of exterior air before the finger has been completely withdrawn from the opening during release of the ball, thereby reducing the strength and effect of any vacuum which may be created at the base or seat area of the insert during rapid withdrawal of a finger which makes airtight engagement with the inside wall of the insert.

DETAILED DESCRIPTION

Figure 1:
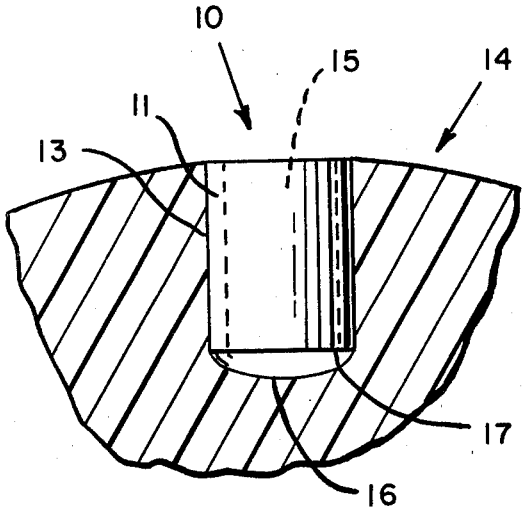
PRIOR ART FIG. 1
FIG. 1 is a diagrammatic cross-section of a bowling ball through one of the finger bores and illustrating a prior art rubber insert attached within said bore.
Figure 2:
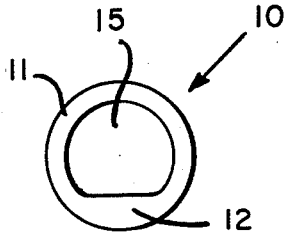
PRIOR ART FIG. 2
FIG. 2 is a top view of the prior art insert of FIG. 1.

Referring to the drawings, FIGS. 1 and 2 illustrate a prior art finger insert for bowling balls, the insert 10 being molded of rubber so as to be about $1\frac{1}{4}$ inches long with a uniform thickness of about $\frac{1}{8}$ inch in the wall 11 except for a maximum thickness of about $\frac{1}{4}$ inch in the area of the flat 12 which extends along the length of the insert. The insert 10 is so oriented when glued into the bore 13 of the ball 14 that the flat 12 of each insert is positioned for contact with the fingerprint surface or undersurface of each finger when the finger is inserted within the opening 15 of the insert 10.

The prior art inserts are available in a number of sizes to accommodate fingers, including thumbs, of various sizes ranging from less than about $\frac{1}{2}$ inch up to less than about $\frac{7}{8}$ inch in general diameter. In all such cases the length and wall thickness remain the same but the inner and outer diameters of the insert vary between a small maximum inner diameter of about ½ inch and a large maximum inner diameter of about ⅞ inch, i.e., from side-to-side. Thus, even in the small size insert, the wall thickness increases the diameter of the bore 13 required to be cut into the ball to a minimum diameter of ¾ inch. Also, the length of the insert requires that the bore is deep since the rounded wall 16 of the bore must begin beyond the base 17 of the cylindrical wall of the insert 10.

FIG. 2 is a view looking into the finger hole 15 of insert 10 and illustrates the uniform thickness of the wall 11 and the appearance of the flat 12 against which the underside of the finger will be positioned during insertion.

Figure 3:
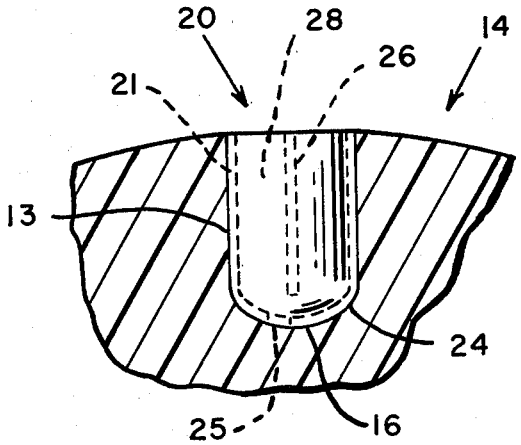
FIG. 3 is a diagrammatic cross-section of a bowling ball through one of the finger bores and illustrating one of the preferred novel inserts of the present invention attached within said bore.
Figure 4:
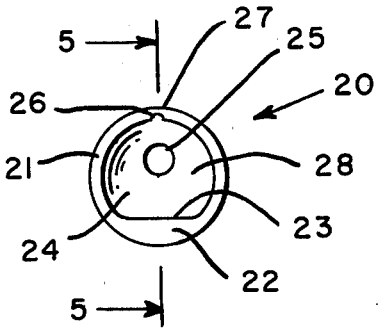
FIG. 4 is a top view of the novel insert of FIG. 3.
Figure 5:
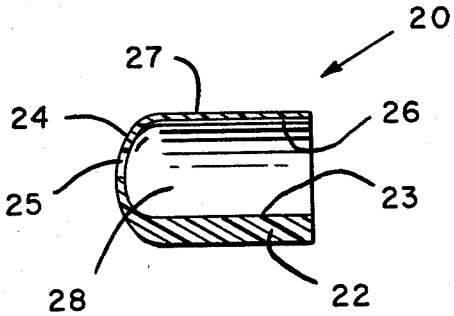
FIG. 5 is a view taken along line 5—5 of FIG. 4.

Referring to FIGS. 3 to 5, the inserts 20 of the present invention according to the illustrated preferred embodiment are finger-receiving silicone cups which have uniformly thin side walls 21 which merge into a thicker bottom wall 22 which has a flat interior surface 23 which extends the length of the insert 20. The thin side walls 21 also merge into a slightly thicker top wall 27 or fingernail wall which extends to the base wall 24 into which all of the walls merge to form a contoured seat or cushion for the fingertip. The exterior surface of the base wall 24 is contoured or, if desired, rounded to conform to the circular curvature of the bore well 16 of the bowling ball and provide intimate contact and attachment thereto, as shown. The base wall 24 is provided with an opening 25 or air hole which is offset from center in the direction away from the flat 23 and which permits the insert 20 to be pushed into the bore 13 during the attachment operation without trapping air at the base of the bore. The offset location of the hole 25 positions it for contact with the fingernail of the bowler so that it is not contacted by the sensitive skin surface of the finger and does not interfere with the feel and comfort of the user.

The insert of FIGS. 3 to 5 also includes a slot or recess 26 which is cut out of the interior surface of the top wall 27 along the length of the insert 20, opposite the flat 23, which recessed area is adjacent the nail portion of the finger of the user and is unimportant to the feel of the ball to the user. The slot 26 provides an air passage when the finger is inserted or withdrawn from the opening 28, thereby permitting the fingers to be inserted without resistance and preventing the build-up of a vacuum and facilitating the smooth withdrawal of the finger without any excessive popping noise normally encountered with bores or inserts which tightly engage a length of the finger. The slot 26 may be cut completely through the wall 27 but more preferably is a recess or plurality of recesses cut into the interior surface of wall 27, preferably extending from the air hole 25 out through the outer lip of the insert 20 to provide one or more complete air passages, as illustrated by FIGS. 3 to 5.

The present inserts 20 preferably have a length of about 1 5/16 inch, side and top wall thicknesses of about 1/16 inch, side, top and bottom walls which contour into the base wall 24 and the hole 25 therein so as to conform to the taper of the fingertips and provide more comfortable engagement, as shown in FIG. 5. The wall thicknesses are maintained substantially the same throughout the range of different sizes available to accommodate fingers of different sizes. Thus, the inner diameter of the finger hole 26, from side-to-side, will vary from about 9/16 inch up to about 13/16 inch, with corresponding variations in the outer diameter of the inserts. Also, the length of the inserts will be cut down from the original length of 1 5/16 inch to suit the size and preference of the individual bowler at the time of drilling and fitting. The final length will vary between about ¾ inch and 1 5/16 inch to accommodate finger joints of different lengths. If desired, the present inserts may be pre-cut and marketed in a wide range to accommodate all bowlers.

Suitable silicone rubber molding compositions are commercially available from a variety of sources such as General Electric Company, Dow Corning, and others. Such compositions are available as paste materials, conventionally used as caulking compounds, which cure on exposure to air and/or heat to form smooth, strong, moisture-resistant, rubbery resilient layers. Such materials can be molded in simple fashion and, thereafter, cut or notched as required.

The present inserts would be obtained in bowling pro shops where the user would be fitted to inserts of the correct sizes and the bowling ball would be bored with receptor holes of the correct sizes and in the correct locations. The inserts are secured within the bores, using a proper adhesive. A preferred adhesive for the present silicone inserts is the same silicone composition from which the inserts are molded. Thus, the outer surface of the insert and/or the interior surface of the bore is coated with a thin film of the uncured silicone composition, the insert is pushed into the bore in proper, seated position and the composition is cured. If desired, the outer surface of the insert may be roughened or provided with ribs in order to obtain increased adhesion.

It will be clear to those skilled in the art that variations may be made in the structure of the present elements to suit the preferences of individual bowlers. Thus, the interior surface of the top or fingernail wall may be tapered downwardly and inwardly to the base wall to provide more intimate and complete contact with the entire fingertip. Also, the recess or slot 26 may be cut completely through the thickness of the top wall and/or may extend only about one-half the length of the element so as to provide for air passage as the finger is moved a portion of the way out of the element during the act of releasing the ball.

The present ball-gripping elements preferably are molded as a step in the process of custom fitting the bowling ball to the particular user. Thus, a plurality of male molds may be provided for the selection of ones which correspond closely to the dimensions of the fingertips of the customer. Said male molds will have a flat bottom surface, in the area of the fingerprint surface of the fingertip, to produce the flat surface 23 of the element, and a raised ridge extending along the top surface, opposite the flat surface, to produce the recess or slot 26 of the element.

A plurality of female molds will also be provided, each corresponding to bowling ball finger bores of different sizes and being paired with the appropriate male mold to provide therebetween a mold cavity for the molding of a ball-gripping insert having the desired wall thickness.

Upon selection of the appropriate male and female mold parts, the parts are assembled and suitable curable rubber molding composition, such as silicone rubber composition, is injected into the mold cavity, cured and removed in the form of a ball-gripping element which is custom sized to the user. The flat undersurface of the male mold forms between itself and the female mold the bottom wall 22 having the flat surface 23 as illustrated by FIGS. 4 and 5. The ridge area of the male mold forms between itself and the female mold the recess or slot 26 illustrated by FIGS. 3 to 5 of the drawing.

Many conventional curable silicone rubber compositions cure on exposure to air and/or elevated temperatures. In most cases, the curing step is initiated within the mold to render the molded element self-supporting and is completed after the mold parts are separated.

Finally, it is noted that the present silicone rubber compositions bond well to diene rubber compositions during the molding step whereas they are relatively inert to conventional diene rubber solvents or cements after they have cured. Therefore, the present ball gripping elements may be molded within thin films, sleeves or sheaths of conventional diene rubber so that the outer circumferential surface of the elements, or a portion thereof, comprises diene rubber. The advantage of this embodiment is that such elements can be cemented within the bore of the bowling ball using conventional rubber cement or other adhesive which dries within a few minutes whereas silicone rubber is inert to such adhesives and requires the use of a curable silicone resin as a bonding agent. The hardening of such silicone bonding agents requires a period of several hours.

Variations and modifications of the present invention will be apparent to those skilled in the art within the scope of the present claims.

I claim:

1. A ball-gripping element adapted to be secured within the finger bore of a bowling ball in order to provide improved, uniform gripping ability, increased contact between the fingers and the ball and smooth release properties, said element comprising a cup molded of silicone rubber, said cup having a cylindrical outer surface adapted to conform to and be secured within the cylindrical bore of a bowling ball, a base wall having a contoured outer base surface adapted to engage the rounded seat of said bore, a central finger-receiving opening within said cup and a contoured seat at the base of said opening adapted to be engaged by the tip of said finger to limit the extent to which said finger can be inserted, said central opening defining between itself and said outer surface a wall comprising opposed thin side wall sections, a bottom or finger grip section having a flat interior surface adapted to be engaged by the undersurface of the finger and an opposed top or fingernail section having at least one recess or slot in the interior surface thereof to permit the passage of air, whereby said central opening is adapted to receive a portion of the finger of a bowler in contact with the inside surface thereof and to release said finger smoothly during the act of bowling.

2. An element according to claim 1 in which the base wall of said cup is provided with a transverse hole which is offset from center in the direction away from the finger grip section of said cup.

3. An element according to claim 1 in which the top or fingernail wall of said cup is provided with an interior recess which does not extend through the thickness of said wall.

4. An element according to claim 1 in which said top or fingernail wall section tapers inwardly and downwardly to the seat at said base to conform to the taper of the tip of a finger.

5. An element according to claim 1 in which said cup molded of silicone rubber comprises a thin film of a diene rubber adjacent the outer surface thereof.

* * * * *